US007562632B2

(12) United States Patent
Hillenbrand et al.

(10) Patent No.: US 7,562,632 B2
(45) Date of Patent: Jul. 21, 2009

(54) GRIPPER FOR TUFTING MACHINE

(75) Inventors: Bernd Hillenbrand, Albstadt (DE); Timo Kaas, Balingen (DE); Andrea Maute, Albstadt (DE); Klaus Kirchmair, Nusplingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/907,033

(22) Filed: Oct. 9, 2007

(65) Prior Publication Data

US 2008/0083359 A1 Apr. 10, 2008

(30) Foreign Application Priority Data

Oct. 6, 2006 (EP) ..... 06 021 002

(51) Int. Cl.
*D05C 15/24* (2006.01)
*D05C 15/00* (2006.01)

(52) U.S. Cl. ..... 112/80.55; 112/80.6

(58) Field of Classification Search ..... 112/80.01, 112/80.5–80.71
See application file for complete search history.

(56) References Cited

U.S. PATENT DOCUMENTS

| | | | | | |
|---|---|---|---|---|---|
| 2,090,021 | A * | 8/1937 | Baynton et al. | ..... | 112/80.59 |
| 2,800,096 | A * | 7/1957 | Signoret | ..... | 112/80.59 |
| 2,990,792 | A * | 7/1961 | Nowicki et al. | ..... | 112/80.52 |
| 3,152,563 | A * | 10/1964 | Broadrick | ..... | 112/80.55 |
| 4,155,318 | A * | 5/1979 | Yamamoto | ..... | 112/80.59 |
| 4,185,569 | A * | 1/1980 | Inman | ..... | 112/80.51 |
| 4,353,317 | A * | 10/1982 | Crumbliss | ..... | 112/80.51 |
| 4,522,132 | A * | 6/1985 | Slattery | ..... | 112/80.51 |
| 4,557,209 | A * | 12/1985 | Watkins | ..... | 112/80.3 |
| 5,738,027 | A * | 4/1998 | White | ..... | 112/80.55 |
| 6,834,602 | B1 * | 12/2004 | Hall | ..... | 112/80.55 |
| 7,007,617 | B2 * | 3/2006 | Johnston | ..... | 112/80.51 |

FOREIGN PATENT DOCUMENTS

| | | | |
|---|---|---|---|
| EP | 000200810 | A1 * | 11/1986 |
| JP | 2006-022410 | A | 1/2006 |
| WO | WO 01/20069 | A | 3/2001 |
| WO | WO 2006/076558 | A | 7/2006 |

OTHER PUBLICATIONS

European International Search Report dated Feb. 28, 2007.

* cited by examiner

*Primary Examiner*—Ismael Izaguirre
(74) *Attorney, Agent, or Firm*—Fitch, Even, Tabin & Flannery; Norman N. Kunitz

(57) ABSTRACT

A gripper (3) for tufting machines comprising a slider (18) that is supported in a gripper body to be movable in longitudinal direction and that is arranged in a slider receiving space (17) which, preferably, is configured as a slit. The slit extends from the lower narrow side (12) of the gripper body (4) into the gripper body. The slit is limited by two thin walls (19, 20) or, alternatively, by only one thin wall (20). A cutting edge insert receiving space 39 is provided above the slider receiving space (17), with the receiving space (39) extending from the flat side (9) end being recessed in the gripper body (4). Between the cutting edge insert receiving space (39) and the slider receiving space (17), a strip (40) is provided that preferably extends in longitudinal direction of the gripper body (4) and separates the receiving spaces (39, 17) from each other.

13 Claims, 2 Drawing Sheets

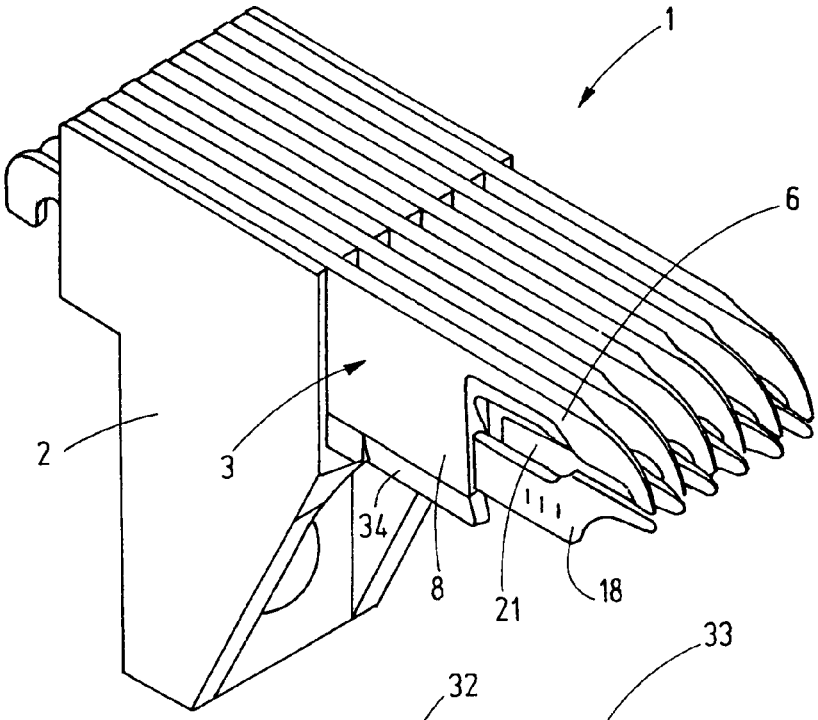
Fig.1
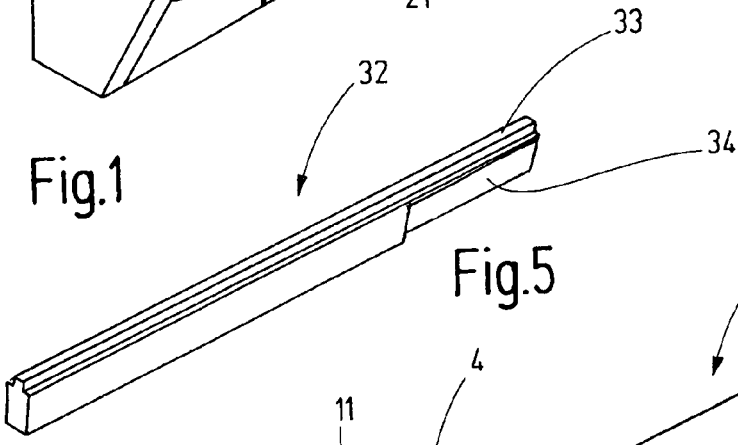
Fig.5
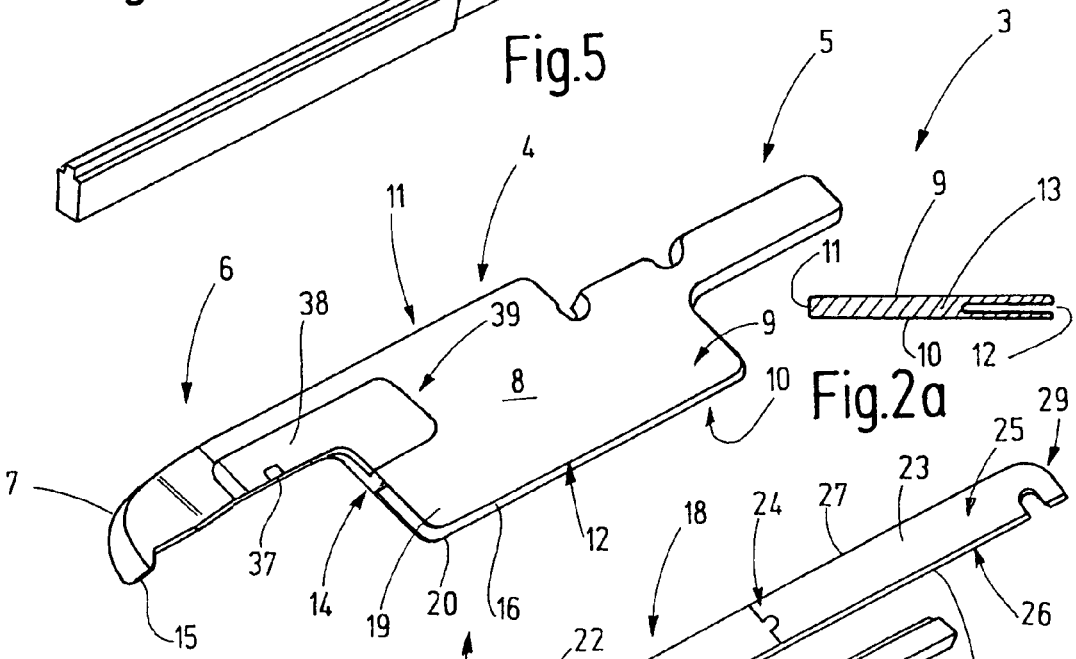
Fig.2a
Fig.2
Fig.4
Fig.3

GRIPPER FOR TUFTING MACHINE

CROSS REFERENCE TO RELATED APPLICATION

This application claims the priority of European Patent Application No. 06 021 002.8, filed on Oct. 6, 2006, the subject matter of which, in its entirety, is incorporated herein by reference.

BACKGROUND OF THE INVENTION

The invention relates to a gripper for a tufting machine, in particular a tufting machine which can be used to selectively produce loop pile or cut pile.

Tufting machines have been known. For example, they are used in carpet manufacturing. In this case, they comprise a table over which the carrier material (the so-called backing) of the future carpet is advanced. A needle bar with needles is located above the carpet, whereby each of the needles has an eye through which the pile thread passes. By rhythmic vertical movement of the bar, this pile thread is repeatedly punched through the backing which is advanced between individual punches. A bar with gripper modules is arranged underneath the backing. The grippers of said module firmly hold the forming pile thread loops during the return stroke of the needle bar. Grippers, which cut open the formed thread loop, respectively in interaction with a knife during a subsequent step, have also been known. Regarding this, it has been known from practical applications to provide a hard-metal insert on the gripper body, said insert having a cutting edge interacting with the knife. If, in addition, the gripper contains a slider in order to selectively switch from loop pile to cut pile and vice versa, the gripper thickness becomes relatively large due to the side-by-side arrangement of the slider and the hard-metal insert. This gripper thickness cannot be randomly reduced because the hard-metal insert requires a minimum thickness of clearly greater than 1 mm. However, the aim is to provide carpets having loop or thread rows at minimal distances.

Considering this, it is the object of the invention to provide a gripper and a gripper module which, on the one hand, permit switching from cut pile to loop pile and which, on the other hand, permit the production of carpets with rows of loop pile threads or cut pile threads following each other closely and exhibiting a long useful life.

SUMMARY OF THE INVENTION

The above object generally is achieved with the gripper in accordance with the invention for a tufting machine, with the gripper comprising: a gripper body that has a cutting edge insert receiving space and a slider receiving a space that is seperated from the cutting edge insert receiving space: a cutting edge insert that is arranged in the cutting edge insert receiving space; and a slider that is arranged in the slider receiving space.

The gripper in accordance with the invention comprises a gripper body with two separate receiving spaces, namely, one receiving space for the cutting edge insert and one receiving space for the slider. Referring to a preferred installation position of the gripper, in which the backing is advanced horizontally or essentially horizontally, the receiving space for the slider and the receiving space for the cutting edge insert are not arranged next to each other but above each other. As a result of this, the individual grippers may have a very slim design. Their thickness needs to be only minimally greater than the minimum thickness of the cutting edge insert. As a result of the slim design of the individual grippers, they can be assembled as a gripper group in an extremely tight arrangement in order to form a gripper module. In particular, the use of a division of less than 1/10 Inch is possible. A gripper module in accordance with the invention comprises means for attachment to a state-of-the-art gripper bar, so that said module can be used in existing machines.

Furthermore, the separation of the two receiving spaces ensures that the slider and the cutting edge insert do not come into contact with each other. Preferably, the slider is enclosed by the material of the gripper body and is optionally enclosed by a closing bar. Tolerances of the cutting insert are not important as regards the guiding precision of the slider. Preferably, a strip of the gripper body separates the slider from the cutting edge insert.

The receiving space for the slider is preferably represented by a deep groove which is provided on a narrow side of the gripper body. The groove guides the slider with minimal play and thus in a precise manner. The manufacture of a module does not require any additional measures to ensure guidance of the slider, such as, for example, the use of guide plates. The slit width and the gripper body width can be adapted to existing requirements and conditions.

On its one end, the slider comprises means consistent with the state of the art, so that said slider can be moved in longitudinal direction by known actuating elements on existing machines. Thus, it is possible to install the gripper or the module in existing machines, without requiring any modification of the machines.

In order for the slider to form a closed thread space with one end of the gripper body that has a projection, said slider being arranged in a receiving space that is vertically separated from the receiving space of the cutting edge insert, the slider tip has an offset. In order to achieve precise covering between the slider tip and the projection of the gripper body, the slider tip may additionally be curved.

For assembly and disassembly, the slider may be divided into two parts. As the clutch between the front slider part that comes into contact with the thread and the rear slider part that is in contact with an actuating device, for example, a pneumatic cylinder, any positive-locking means can be used. For example, the two slider parts are connected to each other in a positive-locking manner in that one slider part is provided with a disk head that is associated with a recess on the other slider part. The two slider parts may also be joined by materials. Joining means can be any means known in the art. Preferably, the clutch is accessible from outside the receiving space for the slider, so that worn sliders can be replaced within a module. As a result of the dual division, a replacement (deinstallation and reinstallation) of the slider is possible even when the front slider section is crimped or offset and, in addition, when the rear slider section is offset. Then the slider is moved in the receiving space to such an extent that it releases the clutch. The slider parts can then be separated from each other and can thus be replaced.

The receiving space for the slider can be covered by a closing bar. Consequently, the gripper consisting of the gripper body, the cutting edge insert, the slider and the closing bar, can be cast in one module, without having the casting material enter into the receiving space for the slider.

The cutting edge insert may consist of a hard metal, a ceramic material or another suitable material on which a durable cutting edge can be provided. Its cutting edge interacts with the cutting edge of a knife in order to produce the cut pile. In order to fix the cutting edge insert in place in the receiving space for the cutting edge, the cutting edge insert may be attached to the gripper body by gluing, soldering, welding, caulking, pressing or in another manner.

Additional details of advantageous embodiments are obvious from the drawings, the description or the claims. The figures of the drawings illustrate embodiments of the inventive gripper and its components. This is restricted to the explanation of essential aspects of the invention and other given conditions. It is obvious that modifications are possible. Less significant, not illustrated, details can be learned—as usual—from the drawings by the person skilled in the art, said drawings supplementing the description of the figures to this extent.

The drawings hereinafter are not consistent with scale; thus, for clarification, the elements of the gripper in the drawings may be illustrated in different sizes.

BRIEF DESCRIPTION OF THE DRAWINGS

FIG. 1 is a perspective illustration of an inventive gripper module having several grippers for a gripper bar of a tufting machine.

FIG. 2 is a perspective view of a gripper body of the gripper module in accordance with FIG. 1.

FIG. 2*a* is a cross-section of the gripper body in accordance with FIG. 2.

FIG. 3 is a perspective view of a slider for the gripper body in accordance with FIG. 2.

FIG. 4 is a perspective illustration of a closing bar for the gripper body in accordance with FIG. 2.

FIG. 5 is a different perspective illustration and a different size of the closing bar in accordance with FIG. 4.

DETAILED DESCRIPTION OF THE INVENTION

Figure 6:
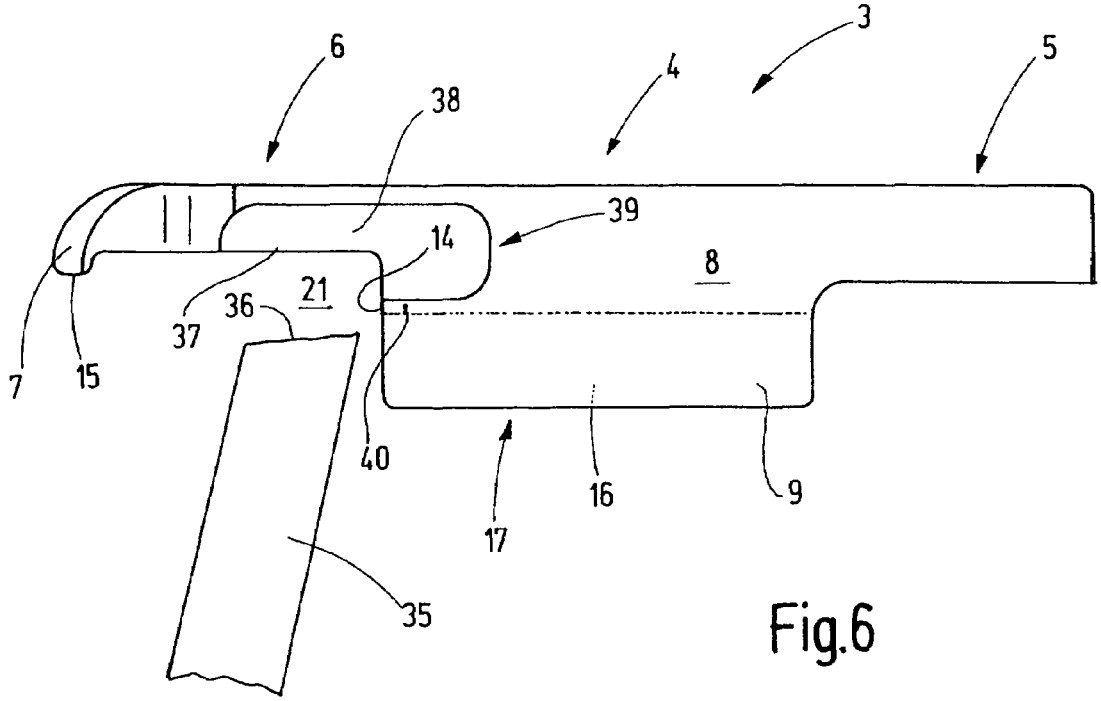
FIG. 6 is a side view of a gripper body with the cutting edge insert and an associate knife.

FIG. 1 shows a module 1 which comprises several grippers 3 in a block 2, whereby each of said grippers has the same configuration. The grippers 3 are set in the block 2, and fixed in position in the body of block 2, for example, by casting, cementing or by other means. The block 2 is used to support and hold the gripper and to fix it in position on a gripper bar of a tufting machine. Said gripper bar consists of a suitable metal (e.g., aluminum alloy, zinc alloy, tin alloy) or of a plastic material.

FIGS. 2, 3 and 4, together, show a perspective exploded view of the gripper 3. The gripper has, for example, a gripper body 4 consisting of steel in accordance with FIG. 2, said gripper body being formed by a flat part having an essentially rectangular cross-section. The flat part has a rear slim end 5 for its support in the block 2 and a front, optionally laterally offset end 6 with a tip 7 that is disposed to come grasp loops. Between the rear end 5 and the front end 6, viewed from the side, an approximately rectangular section 8 is provided, which, as is shown by FIG. 1, partially projects from the block 2 when in use. The two flat sides 9, 10 and the two narrow sides 11, 12 form the limits of the section 8. In so doing, the flat sides 9, 10 and the narrow sides 11, 12 define the rectangular cross-section 13 indicated next to FIG. 2*a*. The flat sides 9, 10 also extend beyond the ends 5, 6 and are preferably largely planar, optionally apart from an offset at the end 6 or the tip 7. The narrow sides 11, 12 follow the contour of the gripper and have flat sections. In the transition region from the end 6 to the section 8, a step 14 is provided in the narrow side 12, so that—as is obvious from FIG. 1—the section 8 clearly extends farther downward than the horizontally aligned end 6. This latter end may also be provided at its tip 7 with a projection 15 that extends slightly downward.

Extending from its narrow side 12, the section 8 is provided with a slit 16, which forms a slider receiving space 17 for the slider 18 that is shown separately in FIG. 3. The slider receiving space 17 is limited by two narrow walls 19, 20 that are aligned parallel to each other. The slit 16 formed between them has a width such that the slider 18 can be easily moved between them. In operative position, the slit 16 has a slit bottom which is at a distance from the lower narrow side of the end 6. During operation, a thread space 21 is formed between the slider 18 and the end 6 of the gripper body 4, as is obvious from FIG. 1.

Figure 7:
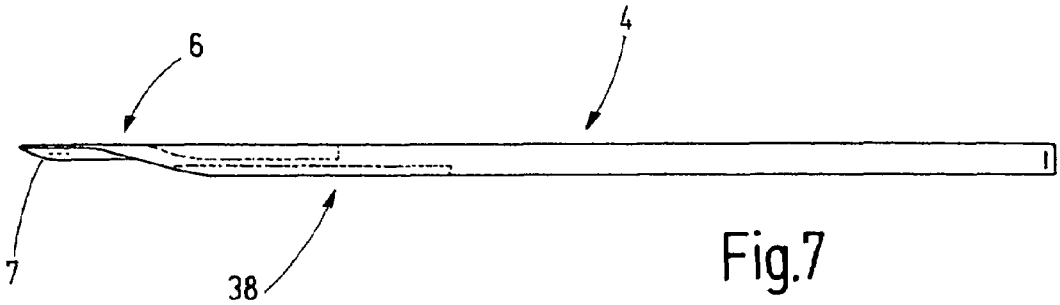
FIG. 7 is a plan view of the gripper body in accordance with FIG. 6.

The slider 18 preferably consists of two parts. Said slider has a front slider part 22 and a rear slider part 23, which are connected with each other via a positive-locking clutch 24. The front slider part 22 and the rear slider part 23 are preferably flat parts that have the same thickness and consist of steel or another suitable material. They have a cross-section having a width that corresponds to the distance between the walls 19, 20, i.e., to the width of the slider receiving space 17, and having a height that is slightly less than the depth of the slit 16. Consequently, the slider 18 has two flat sides 25, 26 and two narrow sides 27, 28, each extending over almost the entire length of the slider 18. On its one end, the slider 18 may be provided with a connector 29 for an actuating element, e.g., an actuating cylinder. The connector may be configured as a cutout, a hole or the like. On its other end 30, said connector has an offset tip 31. This tip may have a double offset, in that it has a section extending, on the one hand, toward the tip 7 of the gripper body 4 and, on the other hand, being offset with respect to the center plane of the remaining slider 18. Due to the section of the slider tip 31 that extends toward the tip 7 of the gripper body 4, the narrow side 27 has a step 41. Also, the tip 7 may be offset accordingly with respect to this center plane, whereby the tip 31 and the projection 15, as shown by FIG. 1, are closely adjacent to each other or may abut against each other. The lateral offset of the slider 18 is disposed to adapt to the asymmetrical arrangement of the tip 7 on the end 3 of the gripper body 4, as is obvious from FIG. 7.

In addition, this gripper 3 is associated with a closing bar 32 illustrated in FIG. 4, whereby said bar has a length that corresponds approximately to the length of the section 8 and is used to close the slit 16. The closing bar, which is straight, has a rib-like projection 33 that fits in the slit 16 and closes said slit. The projection 33 is located opposite the bottom of the slit 16 and guides the slider 18 on its narrow side 28, while the narrow side 27 slides on the bottom of the slit 16. The thickness of the closing bar 32 preferably corresponds to the distance measured between the flat side 9 and the flat side 10 of the section 8.

FIG. 5 illustrates that one front end of the closing bar 32 is provided with a chamfer 34 that deflects the knife. This chamfer is disposed to keep a knife of an adjacent gripper away from the gripper body 4 and, in particular, away from the narrow edges of the slit 16.

A spring, e.g., a leaf spring, may be provided in or on the projection 33 in order to support the slider 18 in the slit 18 without play. Alternatively, the slider 18, or also the slit bottom, may be provided with an appropriate spring.

As is illustrated in FIG. 6, the gripper 3 is associated with a knife 35 that cuts thread loops received by the thread space 21 in order to produce cut pile. On its end side, the knife 35 has a cutting edge 36 which interacts with a cutting edge insert 38. The cutting edge insert 38 preferably consists of a hard metal or of any other suitable material. On its end, said insert has a cutting edge 37 in order to improve cutting the thread loops while interacting with the knife 35 and its cutting edge 36. The cutting edge insert 38 is received by a cutting edge receiving space 39 of the gripper body 4. The cutting insert receiving space 39 is preferably configured as a flat recess in the flat side 9 of the gripper body 4. This recess is open toward the flat side 9. It extends across the step 14 and receives the correspondingly formed cutting edge insert 38 with the cutting edge 37. The cutting edge insert 38 may be fixed in place in the cutting edge insert receiving space 39 by cementing or soldering or in another manner.

As is obvious, the cutting edge insert receiving space 39 and the slider receiving space 17 are accommodated in the gripper body 4, without being in contact with each other. Rather, they are separated from each other by a strip 40 and are superimposed with respect to the vertical mounting direction. As a result of this, on the one hand, the cutting edge insert 38 may have a relatively great thickness and, on the other hand, the gripper body 4 may have a very narrow configuration. In particular when the cutting edge insert 38 consists of a relatively brittle material, such as, e.g., hard metal or ceramic, this insert may easily have the required minimum thickness of, e.g., 1.3 mm. Also, the gripper body 4 may be configured narrow enough that divisions of fewer than 1/10 Inch (2.5 mm) can be easily achieved.

The operation of the gripper and/or module 1 is as follows:

During the tufting process, the module 1 is used for grasping the loops formed under the backing. Referring to a first operating mode, one or more sliders 18 are moved into a rear position. Therefore, the loops arrive on the end 6 and ultimately move over the cutting edge 37. Following the working movement cycle, the knife 35 pushes upward and its cutting edge 36 moves past the cutting edge 37 of the cutting edge insert 38. Due to the resultant shearing effect, the loop seated on the end 6 is cut open. Cut pile is being produced. In so doing, the knife 35 only slips across the cutting edge insert 38 and thus over the material, whereby uniform wear resistance properties prevail. Preferably, said knife does slip across the material of the gripper body 4. The wear of said material remains minimal.

If loop pile is to be produced, the respective sliders 18 are moved into a forward position. The loops formed under the backing are now picked up by the tip 31 of the respective slider and again released during the return stroke of the module 1. Said loops do not enter into the cutting mechanism that consists of the knife 35 and of the cutting edge insert 38.

Figure 8:
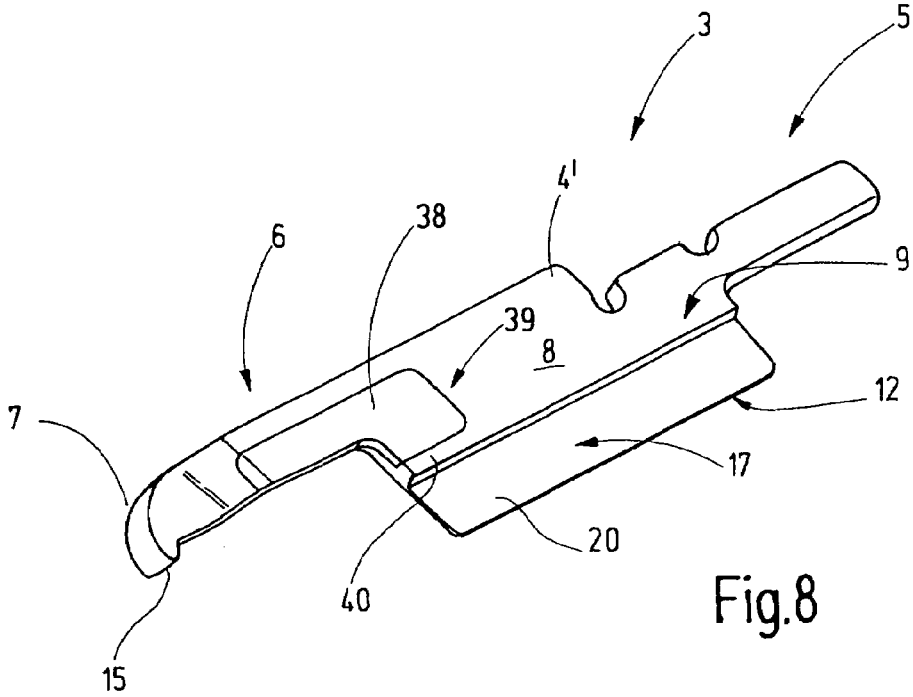
FIG. 8 is a perspective illustration of a modified embodiment of the gripper body in accordance with FIG. 2.

FIG. 8 illustrates a modified embodiment of the gripper 3 with reference to a gripper body 4' and its cutting edge insert 38. In so far as the above-described gripper 3 corresponds to the latter, reference is made to the above description using the same reference numbers as the basis.

Different from the former gripper body 4, the gripper body 4' comprises a recess as the slider receiving space 17, said recess being open in the direction of the flat side 9 as well as toward the narrow side 12. Consequently, the gripper body 4' has only one wall, i.e., the wall 20, but not the wall 19. Accordingly, if required, slightly thicker sliders may be used, these being optionally covered by an L-shaped angle plate or by equal means at the time said sliders are poured in the block 2.

The new gripper design provides a gripper 3 for tufting machines, said gripper comprising a slider 18 that is supported so as to be movable in longitudinal direction. This slider is arranged in a slider receiving space 17 which, preferably, is configured as a slit. The slit extends from the lower narrow side 12 of the gripper body 4 into said gripper body. Said slit is limited by two thin walls 19, 20 or, alternatively, by only one thin wall 20. A cutting edge insert receiving space 39 is provided above the slider receiving space 17, said receiving space 39 extending from the flat side 9 and being recessed in the gripper body 4. Between the cutting edge insert receiving space 39 and the slider receiving space 17, a strip 40 is provided that preferably extends in longitudinal direction of the gripper body 4 and separates the receiving spaces 39, 17 from each other. This design is suitable for the creation of very narrow grippers 3 that permit a division of less than 1/10 Inch.

It will be appreciated that the above description of the present invention is susceptible to various modifications, changes and adaptations, and the same are intended to be comprehended within the meaning and range of equivalents of the appended claims.

LIST OF REFERENCE NUMBERS

1 Module
2 Block
3 Gripper
4 Gripper body 4'
5 End
6 End
7 Tip
8 Section
9 Flat side
10 Flat side
11 Narrow side
12 Narrow side
13 Cross-section
14 Step
15 Projection
16 Slit
17 Slider receiving space
18 Slider
19 Wall
20 Wall
21 Thread space
22 Slider part
23 Slider part
24 Clutch
25 Flat side
26 Flat side
27 Narrow side
28 Narrow side
29 Connector
30 End
31 Tip
32 Closing bar
33 Projection
34 Chamfer
35 Knife
36 Cutting edge
37 Cutting edge
38 Cutting edge insert
39 Cutting edge insert receiving space
40 Strip
41 Step

The invention claimed is:

1. Gripper for a tufting machine, comprising:

a gripper body having two flat sides connected by narrow sides, a cutting edge insert receiving space and a slider receiving space that is separated from the cutting edge insert receiving space, with the slider receiving space being a slit formed between the two flat surfaces of the gripper body;

a cutting edge insert arranged in the cutting edge insert receiving space; and a slider arranged in the slider receiving space.

2. Gripper in accordance with claim 1, wherein the slider receiving space is separated from the cutting edge insert receiving space by a strip of the gripper body.

3. Gripper in accordance with claim 1, wherein the two flat sides and two narrow sides defines rectangular cross-section of the gripper body.

4. Gripper in accordance with claim 1, wherein the slider receiving space of the gripper body is open on the narrow aide thereof.

5. Gripper in accordance with claim 4, wherein the gripper body is provided with a closing bar for the open narrow side of the slider receiving apace.

6. Gripper in accordance with claim 3, wherein the cutting edge insert receiving space of the gripper body is open on the flat side thereof.

7. Gripper in accordance with claim 1, wherein the slider is supported in the slider receiving space of the gripper body so as to be movable.

8. Gripper in accordance with claim 1, wherein the slider and the cutting edge insert are held in the gripper body without being in contact with each other.

9. Gripper in accordance with claim 1, wherein the cutting edge insert consists of a hard metal.

10. Gripper in accordance with claim 1, wherein the cutting edge insert consists of ceramic.

11. Gripper in accordance with claim 1, wherein the slider is designed in two parts and comprises a clutch device for connecting the two parts together, which clutch devise, when in an operative position, is arranged in the slider receiving space.

12. Gripper in accordance with claim 1, wherein the slider receiving space extends in the longitudinal direction of the gripper body.

13. Gripper in accordance with claim 1, wherein the slider receiving space is disposed in the gripper body below the cutting edge insert receiving space when the gripper body is positioned with the flat sides vertically oriented and mounted for use.

* * * * *